United States Patent [19]

Yakubek

[11] Patent Number: 4,524,409

[45] Date of Patent: Jun. 18, 1985

[54] FLASHLIGHT

[75] Inventor: Louis Yakubek, Berlin, Ohio

[73] Assignee: Owens-Illinois, Inc., Toledo, Ohio

[21] Appl. No.: 592,043

[22] Filed: Mar. 21, 1984

[51] Int. Cl.[3] ..... F21L 7/00

[52] U.S. Cl. ..... 362/189; 200/60; 362/196; 362/200; 362/205; 362/295; 362/455

[58] Field of Search ..... 362/189, 200, 205, 295, 362/196, 455; 200/60

[56] References Cited

U.S. PATENT DOCUMENTS

| | | | |
|---|---|---|---|
| 1,122,424 | 12/1914 | Sagebrecht | 362/196 |
| 1,226,727 | 5/1917 | Wacatel | 362/196 |
| 1,492,743 | 5/1924 | Osean | 362/196 |
| 1,588,428 | 6/1926 | Voorhees | 362/196 |
| 1,588,464 | 6/1926 | Osean | 362/196 |
| 2,272,040 | 2/1942 | Muldoon | 362/196 |
| 2,651,710 | 9/1953 | Clark | 362/196 |
| 4,122,510 | 10/1978 | Halliday | 362/189 |
| 4,210,953 | 7/1980 | Stone | 362/189 |
| 4,419,718 | 12/1983 | Chabria | 362/189 |
| 4,443,833 | 4/1984 | Fazzina | 362/189 |

*Primary Examiner*—Stephen J. Lechert, Jr.
*Attorney, Agent, or Firm*—John R. Nelson

[57] ABSTRACT

A compact, easily assembled flashlight is disclosed in which the casing for the flashlight is made of two identically molded plastic halves in which the molded halves are provided with cradles for a pair of batteries, webs for retaining conductive clips and a web adjacent the bottom for holding a spring contact in position beneath the batteries when assembled inside the casing. A light bulb with a pair of external wire leads protrudes through half of a semi-circular opening in each of the halves such that upon assembly of the halves of the casing in overlying position the bulb extends through a circular opening at one end of the casing. The other end of the casing is formed with a flat web having a hole therein. A pair of metallic switch members, which also are integrally formed with spring members for contacting the lower end of the batteries, have contact elements, spaced apart within the casing between the position of the two batteries. The casing is flexible and, upon squeezing or compressing the sides of the casing, the two switch members will contact each other, completing the circuit from the batteries to the light bulb. The flashlight is essentially a disposable item in which, after assembly, the two halves of the casing are welded together to form a sealed unit.

8 Claims, 5 Drawing Figures

FLASHLIGHT

BACKGROUND OF THE INVENTION

This invention relates to relatively small, inexpensive disposable flashlights which, due to their size, are capable of being carried in a purse, a pocket, a work case or glove compartment of an automobile, for example. Flashlights of the general type as set forth in this application are certainly quite old in the art. One currently available flashlight of this type is that disclosed in U.S. Pat. No. 3,796,869, issued Mar. 12, 1974 to W. S. Stone and comprises a housing having a flexible wall in which is carried a battery holder formed with shallow channels in which a pair of batteries are seated. A light bulb is carried at one end of the housing and includes lead wires extending from the bulb which are soldered or welded to one end of the batteries. One end of a conductive switch wire is held agianst the post at the other end of one of the batteries and the other end of the switch wire is arranged to be adjacent to but normally spaced from an exposed conductive surface of the other battery. When it is desired to light the bulb, the outer flexible wall of the housing is pressed or squeezed, causing the other end of the switch wire to contact the exposed surface of the other battery, completing the circuit between the batteries and the bulb. While the just described flashlight has had some acceptance, it is, however, time consuming and expensive to manufacture, principally because of the many pieces and parts that require assembling to make the unit and the welding of the bulb wires to the batteries.

Another patented flashlight similar to that disclosed above is the subject of U.S. Pat. No. 4,032,773 to Halliday, Jr. et al, issued June 28, 1977. In this particular patent there is disclosed a light bulb having a pair of leads extending therefrom which are retained in sockets formed as curled ends of clips that engage a non-conductive plate that spans the ends of a pair of batteries. These batteries are held by a non-conductive clip-like member to keep the batteries separated. The bulb is intended to extend through a generally eliptically shaped cover having a hole in the center thereof through which the lens of the bulb may protrude. This cover engages an elongated eliptical housing comparable to the shape of the cover and a similar shaped end cover will close the lower end of the eliptical housing. The housing is indicated as being made of a flexible plastic material. A second non-conductive plate spans the opposite ends of the batteries and carries a clip to complete the circuit when the wire connected to the lower clip actually contacts the bare side of the other battery case. This is accomplished when the flexible wall of the flashlight is squeezed to effect this contact.

Another more recent U.S. Pat. No. 4,122,510, issued Oct. 24, 1978 to Richard J. Halliday, Jr., discloses a similar arrangement to the above mentioned Halliday patent for producing a flashlight of the type in which a flexible, cylindrical casing containing batteries, light bulb and switching means are enclosed with ends closing the cylinder to form a complete unit. This unit is sealed to form a flashlight which is disposable after its battery life has been depleted. In this patent a pair of oppositely turned batteries, both of which are without an insulating cover, are mounted in a non-conductive clip-like holder. One lead from the light bulb is maintained in contact with the wall of one of the batteries by the clip which holds the battery while the other lead from the bulb is soldered to the positive terminal of the other battery. A conductive member extending from the bottom of one of the batteries is intended to complete the circuit through the side wall or cylindrical surface of the other battery in a manner similar to the previously discussed Halliday patent. In this patent, however, the conductive member is much heavier than a wire. Again, the flashlight is made up of a number of elements such that when all of them are combined, the devices are sealed, and a throw-away flashlight is produced. Again, this flashlight, while generally satisfactory in use, still is expensive and time-consuming to manufacture. One of the inherent difficulties with those flashlights previously made is the corrosion of the contact which is used to effect the opening and closing of the circuit. In most of those prior art flashlights of the sealed type, the contact is a wire or member which touches the outer casing of one of the batteries to complete the circuit. Of course, corrosion will render the flashlight unuseable and in those instances where the contact becomes bent to the extent that it will not separate from the batttery, it will remain lit and quickly deplete the included batteries. Since these are sealed units, there is no intent nor would it be economical to replace the batteries or even to repair the unit.

Accordingly, it is an object of this invention to provide a small, easily carried flashlight that is relatively inexpensive. It is another object of this invention to provide a small flashlight which is easily assembled. It is yet a further object of this invention to provide a small flashlight made from two identical injection molded casing halves such that only a single marginal seal is required to seal the unit.

With the foregoing in view, it is one of the advantages of the present invention that the switch elements are separate elements which have large surface areas and therefore are much less subject to corrosion which would render the contacts inoperative.

Furthermore, it is an object and advantage of the present invention that the casing which makes up the outer portion of the flashlight be formed of two parts of identical shape and configuration. Furthermore, when the batteries, light bulb and elements are fitted within the casing and the two halves sealed together, a complete unit composed of, in total, only nine elements has been formed without requiring soldering or permanent connections during the manufacture therof.

These and other objects will become apparent from the following description.

DETAILED DESCRIPTION OF THE DRAWINGS

Figure 1:
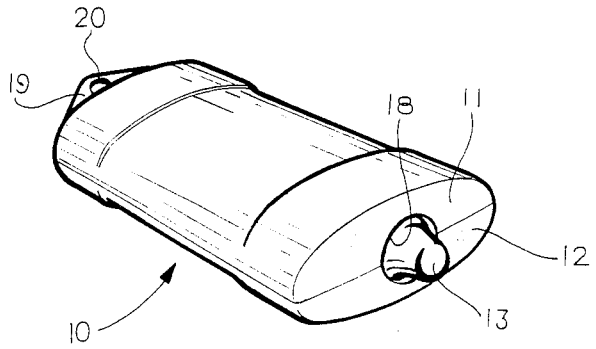
FIG. 1 is a perspective view of a flashlight in accordance with the invention.
Figure 2:
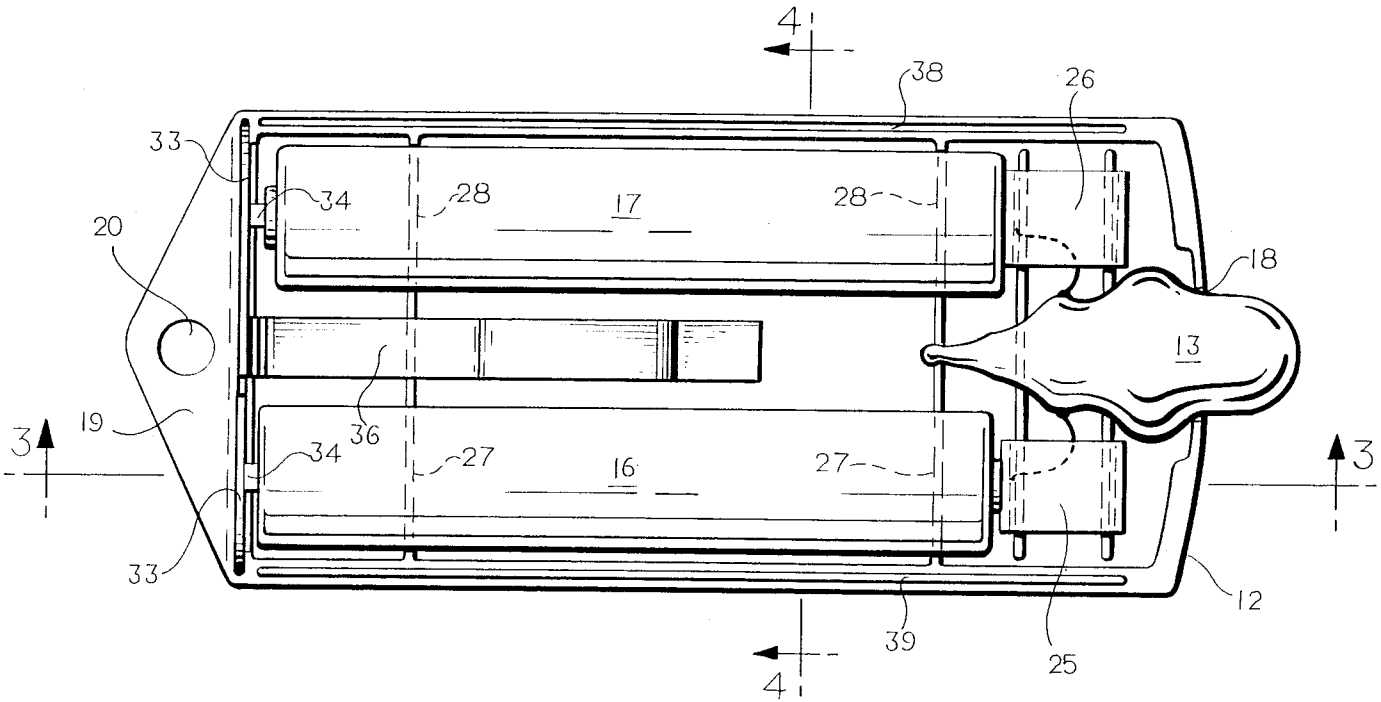
FIG. 2 is a side elevational view of the flashlight of the invention with one cover removed.

With particular reference to the drawings, and in particular FIG. 1, there is shown the flashlight of the invention which basically is formed of an outer casing 10 comprised of two halves 11 and 12 which are injection molded of a flexible plastic, such as polyethylene. Both halves 11 and 12 are semi-eliptical in cross section, identical in shape and interchangeable. Protruding from an end of the casing 10 is an incandescent light bulb 13. The light bulb 13 is a commercially available bulb from the General Electric Company and consists of a glass envelope and a pair of leads 14 and 15 extending out of the bulb. As previously mentioned, the two halves 11 and 12 of the casing 10 are identically molded and, with reference to FIGS. 2 and 3, support a pair of batteries 16 and 17. The batteries 16 and 17 are commercially available 1.5 volt alkaline batteries having a positive terminal at one end with the other end closed by a conductive casing. As shown in FIG. 2, the battery 16 has its positive terminal at the right end and battery 17 has its positive terminsl at the left end.

Each half casing 11 and 12 is formed at the upper end with a semi-circular opening 18 therein. The opening 18 permits the protrusion or extension of the upper end of the bulb 13 therethrough, then the two halves of the casing are sealed or welded together at their margin after assembly. At the opposite end of each half casing there is molded, integrally with the sides and the end half of the bottom, an axially extending web portion intended to be joined to the web portion of the other half of the casing to form an outstanding web 19. The web 19 is provided with a hole 20 therethrough which is a convenient arrangement for attaching a key chain of other flexible carrying device to the flashlight.

Figure 3:
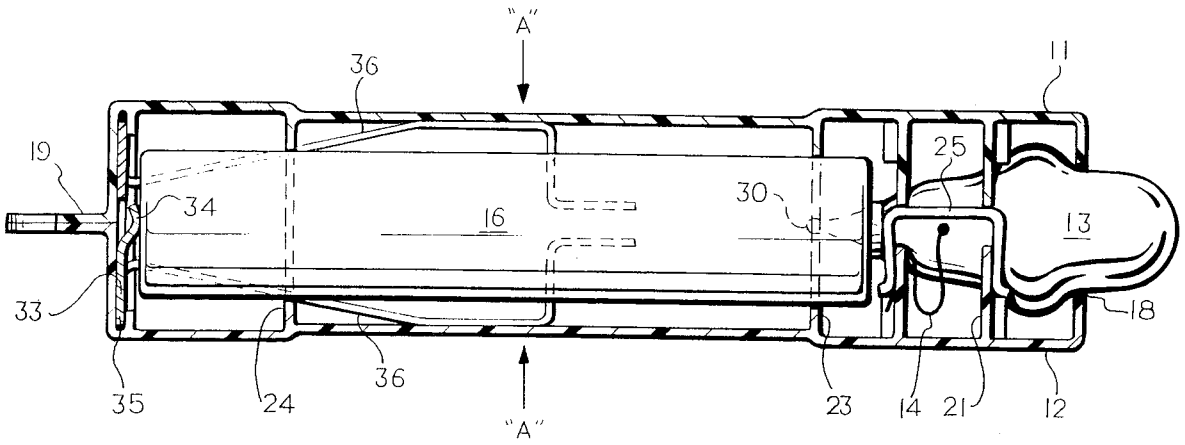
FIG. 3 is a cross-sectional view taken generally at the line 3—3 of FIG. 2 through a complete flashlight.

Between the upper and lower ends of each half of the casing there are four inwardly extending integrally molded supporting webs 21, 22, 23 and 24. The upper two webs 21 and 22 extend from the inside of the outer side wall of the casing to a point less than half the distance to the opposite wall. These webs also present semi-circular centrally located openings of generally the same diameter as the semi-cylindrical opening 18 and serve to position and retain the bulb in the position shown in FIGS. 2 and 3. Furthermore, the webs 21 and 22 serve as supporting members for a pair of U-shaped conductive metal clips 25 and 26. As best shown in FIG. 3, the clip 25 is a generally U-shaped member and is made of spring-like electrically conductive material, and the lead 14 from the bulb 13 is positioned such that the clip 25 will engage and hold the lead 14 against the under surface of the web 22 while the upper leg of the U-shaped clip 25 will engage the upper surface of the upper web 21. In this fashion the lead 14 from the bulb is electrically connected to the clip 25. The clip 26 is connected and mounted to the webs 21 and 22 in the same manner as the clip 25, and it engages and retains the other lead 15 from the bulb 13. When the two halves 11 and 12 are in assembled and sealed condition, the inwardly extending ends of the two webs 21 and 22 which are opposite from the webs 21 and 22 which hold the clips 25 and 26 will engage the backs of the clips 25 and 26 and prevent the clips from being displaced from the position shown in FIGS. 2 and 3.

The inwardly extending webs 23 and 24 are both formed with a pair of spaced-apart generally semi-circular recesses 27 and 28. These semi-circular recesses, which are the same in both halves of the casing, are of a diameter essentially the same as the diameter of the two batteries 16 and 17. Thus, when considering one half of the casing, the recesses 27 and 28 form two spaced-apart cradles for each battery and the recesses 27 and 28 in the other half of the casing, when assembled, form the two complete circular spaced-apart supports for each of the batteries. In addition, the web 23 is provided adjacent its center with a small, semi-circular cutout 29 which, in combination with the other half casing, forms a circular opening within which the lower tip end 30 of the bulb 13 will be positioned.

In axial alignment with the cutout 29, the lower webs 24 are each formed with a rectangular notch 31 therein intermediate the cradles or semi-circular recesses 27 and 28. When in assembled position, the two notches 31 in the respective halves 11 and 12 of the casing will be in alignment and facing each other.

Figure 5:
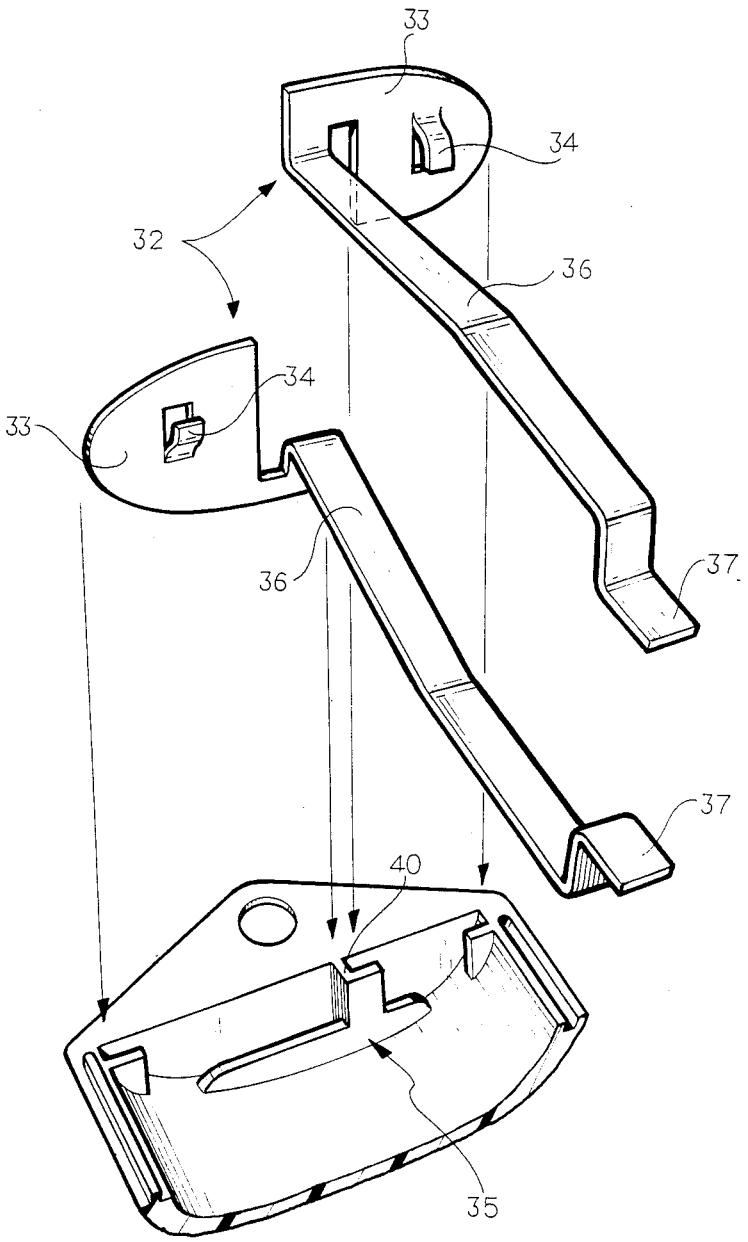
FIG. 5 is an exploded perspective view of the lower contact and switch forming members of the invention and their mounting in one half of the casing.

At the lower end of each of the batteries, adjacent the bottom of the casing as viewed in FIGS. 2 and 3, there is provided a conductive switch contact member 32. These switch members 32 are shown in detail in FIG. 5. It shoud be noted that switch members 32 are identical. It can be seen from FIG. 5 that each of the switch members 32 has a flat base 33 above which is formed a bottom spring contact portion 34. The spring contact 34 actually is stamped out of the base 33 and extends upwardly and then curves generally parallel to the base 33. The base 33 of each of the two switch members 32 is supported and held in engagment with the bottom of the casing by an inwardly extending, integrally formed rib member 35. The rib member 35 is configured with a vertical wall portion 40 such that the bases 33 of the two switch members 32 will fit in and be supported with their bases 33 held against the bottom wall of the casing half and electrically isolated from each other. Each of the switch members is also formed with an upstanding ribbon or arm 36. This ribbon of metal for convenience is bent upwardly from the base 33 and has a configuration such as that shown in FIG. 5 and also as illustrated in FIGS. 2 and 3. The upper end 37 of the ribbon 36 is bent toward the centerline of the lighter and toward the plane of the seal of the two halves; however, the upper end does not extend quite to the center. Similarly, the upper end 37 of the ribbon portion 36 of the switch member 32 will be spaced a slight distance from the center line also. It will be noted when viewing FIG. 3 that both of these switch members 32 have their sides either in engagement with the side walls of the casing or in close proximity thereto such that upon the squeezing of compressing of the side wall in the direction of the arrows A on FIG. 3 the upper ends 37 of the switch members 32 will contact each other and close the circuit from the batteries to the bulb. Each of the ribbons 36 are held in alignment during and after assembly in the previously described generally rectangular notches 31 in each of the halves of the casing. Furthermore, it is apparent that each of the bases 33 of the two switch members by reason of the spring contact 34 will bias the batteries into engagement with the conducting clips 25 and maintain the batteries in contact therewith.

Figure 4:
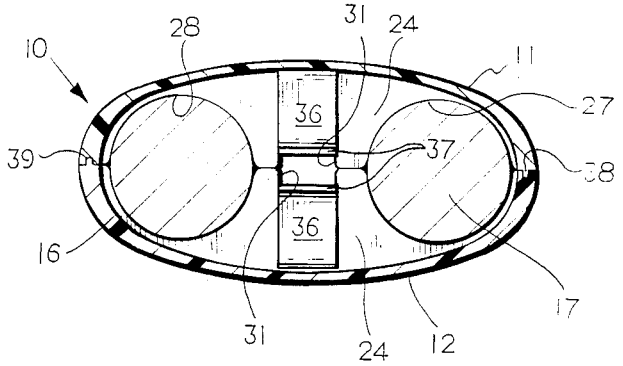
FIG. 4 is a cross-sectional view taken at line 4—4 of FIG. 2.

With the foregoing in view, it can be seen that assembly of the flashlight unit is a fairly straightforward proposition in which the bulb is held in the position in one half 12 of the casing as shown in FIGS. 2 and 3 and the two clips 25 and 26 then may be engaged with the webs 21 and 22 so as to clamp and engage the leads 14 and 15, respectively, from the bulb 13. The switch members 32 then may be assembled into the narrow slot formed between the base of the half 12 and the web 35 therein, as illustrated in Fig. 4. At this time the batteries 16 and 17 may be assembled and placed in their proper position. The other half 11 of the case then is placed over the half 12 to complete the assembly of the flashlight. To aid in assembling the half 11 to the half 12 along one side of the half casing there is formed an elongated groove 38, while along the opposite side of the casing half there is molded an elongated tongue 39. Upon assembly, the tongue of the side 12 will be inserted into the groove of the half 11 of the casing and vice versa, thus assuring alignment of the two halves of the casing. At this point in time the two casing halves are sealed together, preferably by ultrasonic welding, along their edges to thereby form a completely sealed flashlight.

With the flashlight of the invention it can be seen that there are, in number of parts, the two casing halves, the light bulb, two conductive clips and two switch members. Therefore, the entire assembly of the unit only requires nine elements including the two batteries. These batteries are commercially available 1.5 volt batteries and the bulb is a commonly produced three volt bulb. The compactness and simplicity of the unit forming the flashlight, which only involves an assembly of nine elements in total, including the batteries, thus presents an economical, easy to assemble and manufacture flashlight.

It should also be noted that both casing halves are identical, as are the clips 25 and 26 and the switch members 32. This, of course, greatly assists in the assembly of the parts, because there are no confusing, right and left hand, part, only the batteries need be reversed in order to provide proper assembly of the parts into the completed flashlight. In effect, an inventory of only five different parts is required for the unit.

I claim:

1. In a battery operated flashlight wherein an end portion of a bulb extends through one end of an elongated casing which supports the bulb, a pair of batteries in side-by side, spaced relationship and a circuit which is completed between the batteries and the bulb by compressing the sides of the casing, the improvement wherein said casing is formed of two identical elongated, semi-eliptical, molded plastic halves, marginally sealed together in face-to-face relationship with the end portion of the bulb extending through an opening formed by matching semi-circular walls at the margin of one end of the halves.

2. The flashlight of claim 1 wherein each case half includes internally molded, integral, cradle means for supporting the pair of batteries in side-by-side, spaced relationship when said casing is sealed.

3. The flashlight of claim 1 wherein said bulb has a pair of external leads, a pair of conductive clip members, each clip member frictionally engaging a respective lead and being electrically isolated from each other, and means integrally formed in said case for supporting each clip in contact with adjacent ends of a pair of batteries held in said case in spaced-apart parallel relationship.

4. The flashlight of claim 1 wherein said bulb is electrically connected to one end of each batter, a pair of identically formed, spring contact members in said case engaging the opposite ends of said batteries, said contact members being supported and electrically isolated from each other by the case halves with opposed portions of said contacts, in the area between the batteries, lying adjacent the flexible side walls of the casing and being engageable upon compressing the side walls a predetermined amount.

5. The flashlight of claim 1 further including an integrally molded web portion extending from the end of said casing opposite said bulb.

6. The flashlight of claim 5 wherein said integrally molded web portion is formed in both casing halves and sealed together as a unit.

7. The flashlight of claim 6 wherein said extending web portions are provided with a hole therethrough adapted to receive a flexible support member.

8. The flashlight of claim 3 wherein said clips are generally U-shaped and said means for supporting said clips comprising a pair of horizontal spaced-apart ribs extending at right angles to and formed integral with the side wall of each casing half, with the legs of the U embracing the ribs, wherein the ribs on the casing half that is opposed to the clips, engages the bottom of the U clips when assembled with the other casing half.

* * * * *